US005368430A

United States Patent [19]

Lin

[11] Patent Number: 5,368,430

[45] Date of Patent: Nov. 29, 1994

[54] PARKING DEVICE

[76] Inventor: Pei-Chang Lin, P.O. Box 82-144, Taipei, Taiwan, Prov. of China

[21] Appl. No.: 95,174

[22] Filed: Jul. 21, 1993

[51] Int. Cl.[5] ..... B66F 7/14

[52] U.S. Cl. ..... 414/228; 187/406

[58] Field of Search ..... 414/227-229, 414/662, 672, 227, 283; 187/95

[56] References Cited

U.S. PATENT DOCUMENTS

| | | | |
|---|---|---|---|
| 3,035,663 | 5/1962 | Mehlmann | 187/95 X |
| 3,468,401 | 9/1969 | Letz | 187/95 X |
| 4,026,388 | 5/1977 | Creissels | 187/95 X |
| 5,015,146 | 5/1991 | Barnes et al. | 414/662 X |

FOREIGN PATENT DOCUMENTS

| | | | |
|---|---|---|---|
| 699730 | 12/1964 | Canada | 414/662 |
| 2607175 | 5/1988 | France | 414/227 |
| 2258213 | 2/1993 | United Kingdom | 414/227 |

*Primary Examiner*—David A. Bucci
*Attorney, Agent, or Firm*—Alfred Lei

[57] ABSTRACT

This invention relates to a parking device and in particular to one which includes a vertical support, a vertical frame movably connected with the vertical support, a dog slidably mounted in the vertical frame, and a base frame fixedly connected with the dog, whereby the vertical frame together with the base frame may be elevated and rotated as required.

1 Claim, 2 Drawing Sheets

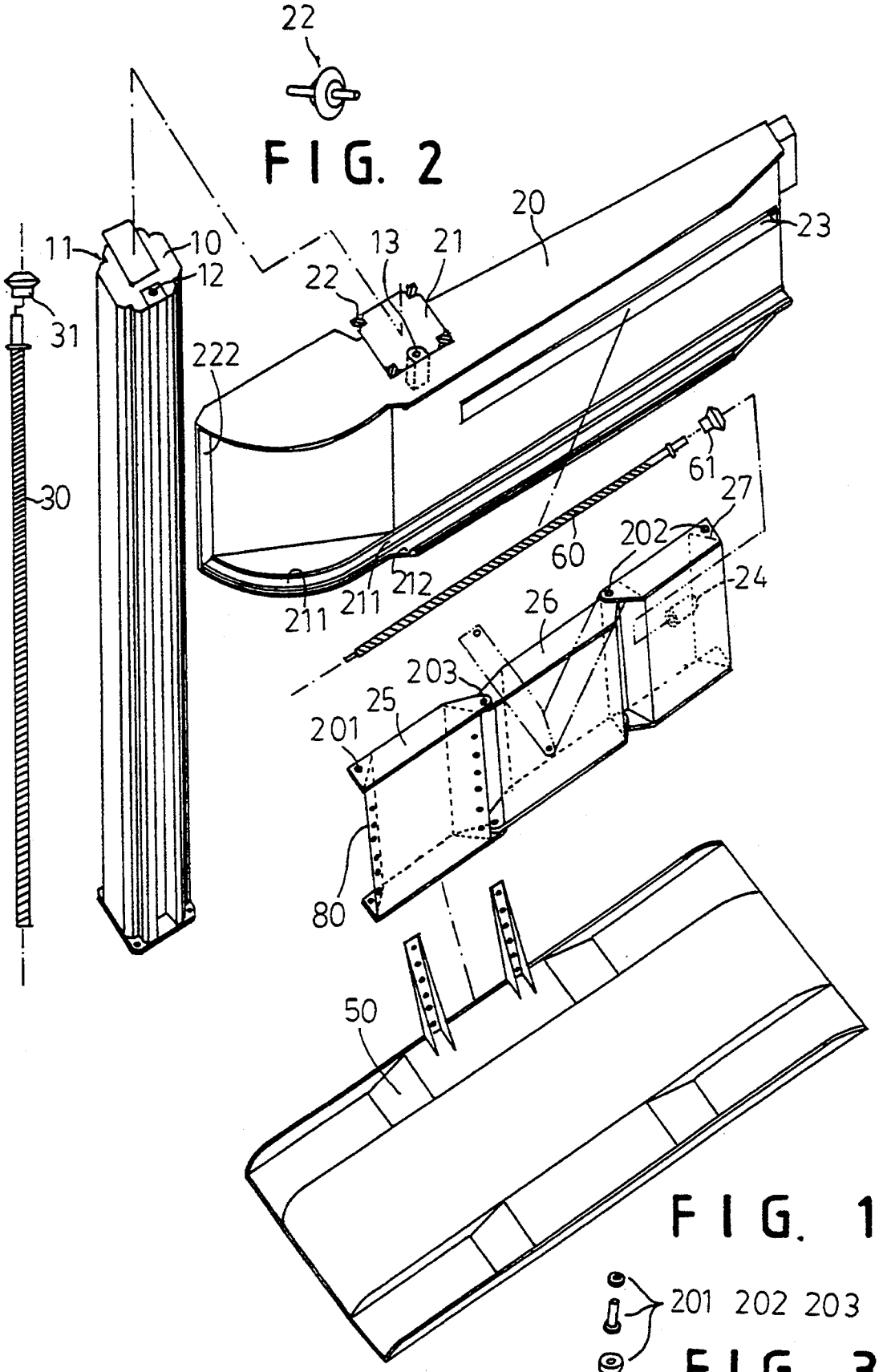
FIG. 2
FIG. 1
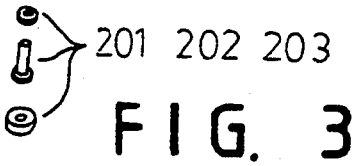
FIG. 3

PARKING DEVICE

BACKGROUND OF THE INVENTION

It has been found that all parking devices sold on the market can only be moved up or down and cannot be rotated as required thereby causing much inconvenience in use.

Therefore, it is an object of the present invention to provide a parking device which may obviate and mitigate the above-mentioned drawback.

SUMMARY OF THE INVENTION

This invention relates to an improved parking device.

It is the primary object of the present invention to provide a parking device which may be elevated and rotated as required.

It is another object of the present invention to provide a parking device which is simple in construction.

It is still another object of the present invention to provide a parking device which is easy to operate.

It is still another object of the present invention to provide a parking device which is economic to produce.

It is a further object of the present invention to provide a parking device which is practical in use.

The invention accordingly consists of features of constructions and method, combination of elements, arrangement of parts and steps of the method which will be exemplified in the constructions and method hereinafter disclosed, the scope of the application of which will be indicated in the claim following.

BRIEF DESCRIPTION OF THE DRAWINGS

FIG. 1 is an exploded view of a parking device according to the present invention;

FIG. 2 is an enlarged view of the roller;

FIG. 3 is an enlarged view of the bearing; and

DETAILED DESCRIPTION OF THE PREFERRED EMBODIMENT

Figure 4:
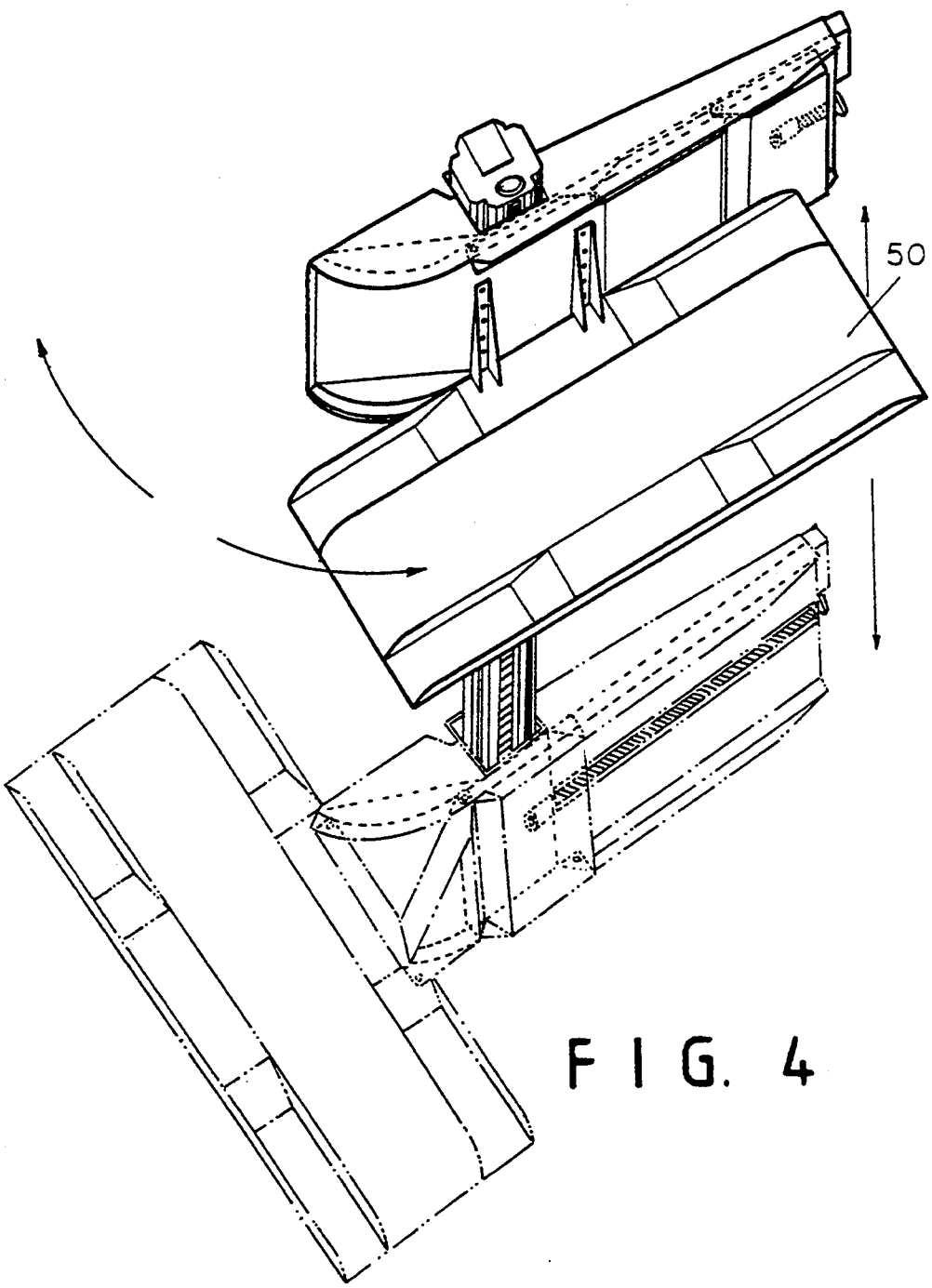
FIG. 4 shows the way the parking device works.

With reference to the drawings and in particular to FIG. 1 thereof, the parking device according to the present invention mainly comprises a vertical support 10, a vertical frame 20, a base frame 50, and a dog 80.

As illustrated, the vertical support 10 is formed with four grooves 11 and a hole 12 in which is inserted a screw 30. The vertical frame 20 is provided with a tubular member 21 on each corner of which is mounted a roller 22 so that the tubular member 21 of the vertical frame 20 may be fitted on the vertical support 10 with a roller 22 engaged with the corresponding groove 11 of the vertical support 10 thereby enabling the vertical frame 20 to slide along the vertical support 10. Further, the tubular member 21 of the vertical frame 20 has a first seat 13 in which is fixedly fitted a first nut 31. The first nut 31 is engaged with a first screw rod 30 so that when the screw 30 is turned, the vertical frame 20 together with the nut 31 will be moved up or down. In addition, the vertical frame 20 is provided with a recess 23 in which is rotatably mounted a second screw rod 30. Moreover, the vertical frame 20 is formed with an inner rack 211, an outer rack 212, and a stop member 222 at the end of the inner rack 211.

The dog 80 is composed of a first leaf 25 having a bearing 201 at the left end (with respect to FIG. 1), a second leaf 27 having a bearing 202 at the right end (with respect to FIG. 1), and a third leaf 26 pivotally connected with the first leaf 25 by a bearing 203 and the second leaf by a bearing 202. The dog 80 is fitted in the vertical frame 20 so that the bearings 201 and 202 are engaged with the inner rack 211 while the bearing 203 with the outer rack 212. Hence, the dog 80 may be moved with respect to the vertical frame 20. The second leaf 27 is provided with a second seat 24 in which is fixedly fitted a second nut 61. The second nut 61 is engaged with a second screw rod 60 so that when the screw rod 30 is turned, the dog 80 will be moved along the racks 211 and 212 of the vertical frame 20.

The base frame 50 is used for supporting an automobile (not shown) thereon and fixedly connected with the first leaf 25 of the dog 80.

When desired to adjust the height of the base frame 50, simply rotate the first screw rod 30 thereby moving the vertical frame 20 together with the dog 80 and the base frame 50 to go upward or downward. When desired to rotate the base frame 50, simply rotate the second screw rod 60 so that the dog 80 will be moved together with the base frame 50 along the racks 211 and 212 of the vertical frame 20 thus rotating the base frame 50 to a desired position.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A parking device comprising:

a vertical support formed with four grooves;

a vertical frame provided with a tubular member and movably engaged with the grooves of said vertical support;

a dog slidably mounted in said vertical frame and including a first leaf, a second leaf and a third leaf pivotally connected between said first leaf and said second leaf; and a base frame fixedly connected with the first leaf of said dog;

whereby said vertical frame together with said base frame may be elevated and said base frame may be rotated as required.

* * * * *